US007422101B1

(12) United States Patent
Forsline et al.

(10) Patent No.: US 7,422,101 B1
(45) Date of Patent: Sep. 9, 2008

(54) STORING AND USING ARTIST PASTELS IN GODETS

(75) Inventors: Ladd Forsline, Kutztown, PA (US); Susanna Starr, New York, NY (US)

(73) Assignee: Colorfin, LLC, Kutztown, PA (US)

( * ) Notice: Subject to any disclaimer, the term of this patent is extended or adjusted under 35 U.S.C. 154(b) by 34 days.

(21) Appl. No.: 11/212,196

(22) Filed: Aug. 26, 2005

Related U.S. Application Data

(63) Continuation of application No. 11/152,014, filed on Jun. 13, 2005, now abandoned.

(60) Provisional application No. 60/578,945, filed on Jun. 11, 2004.

(51) Int. Cl.
*A45C 11/00* (2006.01)

(52) U.S. Cl. ..... 206/1.8

(58) Field of Classification Search ..... 206/1.7–1.9, 206/81, 385, 575, 581, 823; 132/293–307
See application file for complete search history.

(56) References Cited

U.S. PATENT DOCUMENTS

| | | | | |
|---|---|---|---|---|
| 1,194,185 A | | 8/1916 | Kendall | |
| 1,213,501 A | | 1/1917 | Kendall | |
| 1,601,756 A | | 10/1926 | Kendall | |
| 1,602,981 A | * | 10/1926 | Kendall | 132/293 |
| 1,647,916 A | * | 11/1927 | Kendall | 132/293 |
| 1,771,147 A | | 7/1930 | Spender | |
| 2,866,467 A | | 12/1958 | Bradford | |
| 2,990,054 A | | 6/1961 | Gellman | |
| 3,951,679 A | * | 4/1976 | Bernhard et al. | 106/418 |
| 4,205,997 A | * | 6/1980 | Hesse et al. | 524/548 |

(Continued)

FOREIGN PATENT DOCUMENTS

JP 02057203 A 2/1990

(Continued)

OTHER PUBLICATIONS

Website Printout, Winsor & Newton-Oil Paint Bars, http://ww-wreuels.com/reuels/page52.html, Dec. 15, 2005, pp. 1-2.

(Continued)

*Primary Examiner*—Jacob K. Ackun, Jr.
(74) *Attorney, Agent, or Firm*—Patterson, Thuente, Skaar & Christensen, P.A

(57) ABSTRACT

Artist pastels are stored and utilized as a pressed powder that is retained within a pan-like container or godet. The godet is a container having a bottom, at least one side and a top opening that defines a recess area to receive the pressed powder to be used as an artist pastel. In one embodiment, a non-thermally activated adhesive layer is positioned generally along at least a portion of an inner surface of the bottom of the container. In another embodiment, surface features are defined on the inner surface of at least the bottom of the container in order to create a generally lateral force component that the container applies to the pressed powder material to resist cracking of the pressed powder material in response to removal of a portion of the pressed powder material from the top opening. Preferably, the colorized pressed powder composition has a durometer of less than about 70 Shore A and has a pigment content of greater than 25%.

31 Claims, 6 Drawing Sheets

U.S. PATENT DOCUMENTS

| | | | | |
|---|---|---|---|---|
| 4,337,859 | A * | 7/1982 | Murphy et al. | 206/37 |
| 4,616,748 | A | 10/1986 | Thomas et al. | |
| 5,005,697 | A * | 4/1991 | Jimbo et al. | 206/235 |
| 5,318,171 | A * | 6/1994 | Szekely | 206/1.7 |
| 5,388,689 | A | 2/1995 | Kroop et al. | |
| 5,860,518 | A | 1/1999 | Axelrod | |
| 6,173,719 | B1 | 1/2001 | Petit | |
| 6,517,820 | B1 * | 2/2003 | Robert | 424/69 |
| 6,524,597 | B2 | 2/2003 | Kashimoto | |
| 6,698,585 | B2 | 3/2004 | Kammerer | |
| 6,953,543 | B2 * | 10/2005 | Maio et al. | 264/279 |
| 2003/0031692 | A1 * | 2/2003 | Jager Lezer | 424/401 |
| 2004/0040570 | A1 | 3/2004 | Shih | |
| 2005/0109363 | A1 | 5/2005 | Matsuoka | |

FOREIGN PATENT DOCUMENTS

| | | | |
|---|---|---|---|
| JP | 09098830 | A | 4/1997 |

OTHER PUBLICATIONS

Website Printout, Specialty Paints, http://www.hawaiiangraphics.com/specialty_paint_page.html, Dec. 15, 2005, pp. 1-3.

Website Printout, Winsor & Newton Oil Bars, http://www.hawaiiangraphics.com/wn_oil_bar_page.html, Dec. 15, 2005, pp. 1-3.

* cited by examiner

STORING AND USING ARTIST PASTELS IN GODETS

CROSS-REFERENCE TO RELATED APPLICATIONS

This application is a continuation of application Ser. No. 11/152,014 filed Jun. 13, 2005, now abandoned, which claims the benefit of U.S. Provisional Application No. 60/578,945 filed Jun. 11, 2004.

FIELD OF THE INVENTION

The present invention relates to receptacles and packaging for artist equipment. More particularly, the present invention relates to apparatus and methods for storing and utilizing artist pastels as a pressed powder that is retained within a pan-like container or godet.

BACKGROUND OF THE INVENTION

Artist pastels and chalks in the conventional round or square stick-like format are well known. Different kinds of storage containers and packaging have been developed to store and transport stick-format pastels and chalks. Case and tray arrangements and other types of storage containers for stick-format pastels and chalks are shown, for example, in U.S. Pat. Nos. 4,616,748, 5,388,689, 5,860,518 and 6,698,585.

Pan-like containers, such as godets or compacts, have long been used to hold pressed powder formulations for cosmetic applications. These cosmetic containers come in a variety of shapes (e.g., round, square, half-round, etc.) and configurations (e.g., lid, no lid, multiple compartments, etc.). The containers are typically made of plastic or metal with a flat bottom and sides at a right angle to the bottom portion. In some of these containers, the bottom portion can include ridges that increase the structural integrity of the container. Recent examples of improvements in the design of such cosmetic containers are shown, for example, in U.S. Publ. Appl. No. 2005/0109363 and Japanese Abstracts Nos. JP/9098830 and JP/2057203.

Because of safety concerns, the compositions of cosmetics are closely regulated by the Food and Drug Administration (FDA). While certain types of cosmetics, such as lipstick, can be provided in either a stick format or a pan format, pressed powder cosmetics like eye shadow and blush are only available in a pan format where an applicator of some type (e.g., a brush or sponge) is used to apply the cosmetic. There is no direct application of a pressed powder material in stick format for cosmetics. One reason is that the pressed powders for cosmetics are generally softer than, for example, sticks of chalk or pastels. Another reason is that the amount of pigment in pressed powder cosmetics is typically quite low (i.e., <10% and typically only about 2-3%), while the amount of fillers and binders is much higher (i.e., >50%). Because the pressed powder cosmetic is applied directly to the skin, the amount of pigment that can be used is necessarily limited to avoid problems of biocompatibility, removability and long term effect of the cosmetic material.

U.S. Pat. No. 6,524,597 describes the conventional problems and techniques for manufacturing pressed powder cosmetic materials. This patent teaches a new composition for pressed powder cosmetics using a surface treatment with a fluorine compound. The resulting cosmetic pressed powder has a smooth feel and overcomes the problems of cracking and caking that occur when the hardness or durometer of the pressed powder composition is decreased.

Pressed powder cosmetic formulations can be fragile, and can easily break, chip or crack during application and/or storage of the pressed powders. Generally, pressed powder cosmetic formulations with a higher percentage of binders and/or formulations pressed at a higher pressure tend to be less fragile than those pressed at a lower pressure or with less binder content. However, as the pressed powder cosmetic is removed from the container and the level of pressed powder approaches the bottom surface of the container, the remaining pressed powder cosmetic in the container tends to become ever more fragile and prone to breakage. This is an undesirable characteristic as the remaining material that is cracked or broken is generally unusable, and is thus wasted.

Japanese Abstract No. JP/9098830 describes one embodiment of a container for pressed powder cosmetics in which a hot melt adhesive is used as part of the manufacturing process to aid in retaining the cosmetic pressed powder in the container. The use of such a holt melt adhesive, however, could have significant impact on the biocompatibility and toxicity of the cosmetic material due to both the heating of the pressed powder that can affect coloration of the pigment components and the potential leaching of the hot melt adhesive into the pressed powder composition.

While there have been numerous containers and compositions developed for pressed powder cosmetics, these techniques and approaches are geared toward the regulatory and other requirements specific to cosmetic materials. As a result, there have been few attempts to bring any of the teachings related to pressed powder materials from the field of cosmetics into the field of artist materials and equipment.

SUMMARY OF THE INVENTION

The present invention relates to apparatus and methods for storing and utilizing artist pastels as a pressed powder that is retained within a pan-like container or godet. The godet is a container having a bottom, at least one side and a top opening that defines a recess area. In one embodiment, a non-thermally activated adhesive layer is positioned generally along at least a portion of an inner surface of the bottom of the container. A colorized pressed powder material that is to be used as an artist pastel is positioned within the recess area on top of the adhesive layer. Preferably, the colorized pressed powder composition has a durometer of less than about 70 Shore A and has a pigment content of greater than 25%.

In another embodiment, surface features are defined on the inner surface of at least the bottom of the container in order to create a generally lateral force component that the container applies to the pressed powder material to resist cracking of the pressed powder material in response to removal of a portion of the pressed powder material from the top opening. In this embodiment, adhesive materials on the inner surface can be used to increase the adhesion of the pressed powders to the side and/or bottom surfaces of the container, thereby further reducing cracking or chipping of the pressed powder as the pressed powder is consumed during application. The surface features can define cavities in the bottom inner surfaces of the container, which facilitate the creation of a lateral force component that aids in interlocking of the pressed powder and the container. Preferably, the surface area of the cavities occupies between about 5 percent and about 65 percent of the bottom inner surface area, and more preferably between about 20 percent and about 40 percent of the bottom inner surface area. Alternatively, the surface features can be defined in terms of an equivalent surface area that is preferably at least twice, and more preferably at least three times, that of the surface area defined by the perimeters of the container, or an equivalent roughness of the surface that is equivalent to a roughness measure ranging from 150 to 600 grit and more preferably between 150 to 400 grit.

In another embodiment, the inner surface of the sidewall of the container can be sloped or curved to facilitate more even consumption of the pastel powder and less waste as the pastel powder is consumed from the container. This feature minimizes the situation encountered in conventional pan-like containers with straight sidewalls that are generally perpendicular to the bottom where the central portion of the pressed powder tends to be consumed, while the portions of the pressed powder proximate the sidewalls and/or in the corners of the container tend to be unused and ultimately discarded by the user. In a conventional pan-like container, these straight sidewalls tend to enhance the retention of the pressed powder within the container by providing the lateral force component pressing on the pressed powder. In this embodiment of the present invention, the surface features and/or adhesive layer on the bottom and side inner surfaces at least compensate for any loss of lateral pressure force component exerted by straight sidewalls, thereby permitting this embodiment of the present invention to utilize sloped or curved inner surface of the sides.

In a further embodiment, the containers or godets of the present invention can be organized together as part of a kit with multiple godets where each godet contains a different color and each godet further comprise a lid member operably coupled to the body portion of the container that can be selectively moved from an open position to a closed position. The plurality of godets in each kit may be stored in a case adapted to receive a plurality of godets. Additionally, each godet can include an adhesive layer and/or surface features positioned along the sidewalls and/or the bottom member of the godet to facilitate securing the pressed powder to the godet, which can reduce cracking and/or chipping of the pressed powder. In these embodiments, preferably the lid member can include a latch structure designed to engage and disengage with a corresponding structure on the body portion of the godet to secure the lid member to the body portion. Preferably, the lid member can be composed of a transparent polymer, which permits a user to distinguish the color of the colorized pressed powder pastel stored in the godet without opening the lid. The kit may also include one or more applicators such as brushes, rollers, pads and the like. Suitable applicators are described in co-pending application Ser. No. 11/074,989, filed on Mar. 8, 2005, entitled "Novel Appliances For Art And Craft Media And The Like," which is hereby incorporated by reference herein.

Preferably, the godets of the present invention are adapted to store a colorized pressed powder material for use as an artist pastel. Suitable pastel composition are described in, for example, co-pending patent application Ser. No. 11/042,708, filed on Jan. 25, 2005, entitled "Novel Oil Pastel Compositions And Methods Of Making Same," and co-pending patent application Ser. No. 11/042,712, filed on Jan. 25, 2005, entitled "Novel Soft Pastel Compositions And Methods Of Making Same," the disclosures of both of which are hereby incorporated by reference herein.

DETAILED DESCRIPTION OF THE INVENTION

Figure 1:
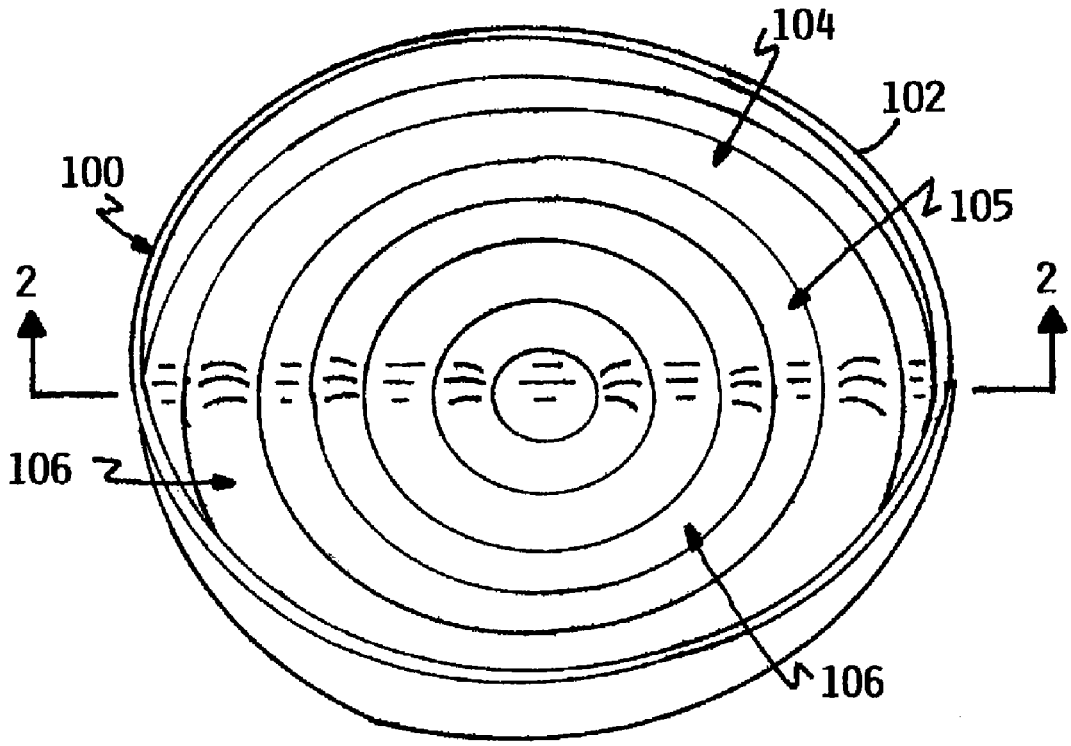
FIG. 1 is a perspective view of an embodiment of a conventional godet having ridges along the bottom surface of the godet that includes an adhesive layer in accordance with the present invention.
Figure 2:
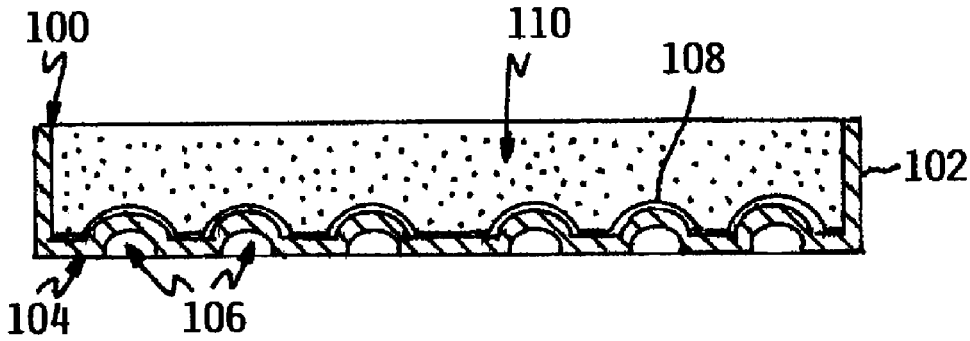
FIG. 2 is a cross-sectional view of the godet of FIG. 1 depicting an adhesive layer positioned along the side and bottom surfaces of the godet.
Figure 3:
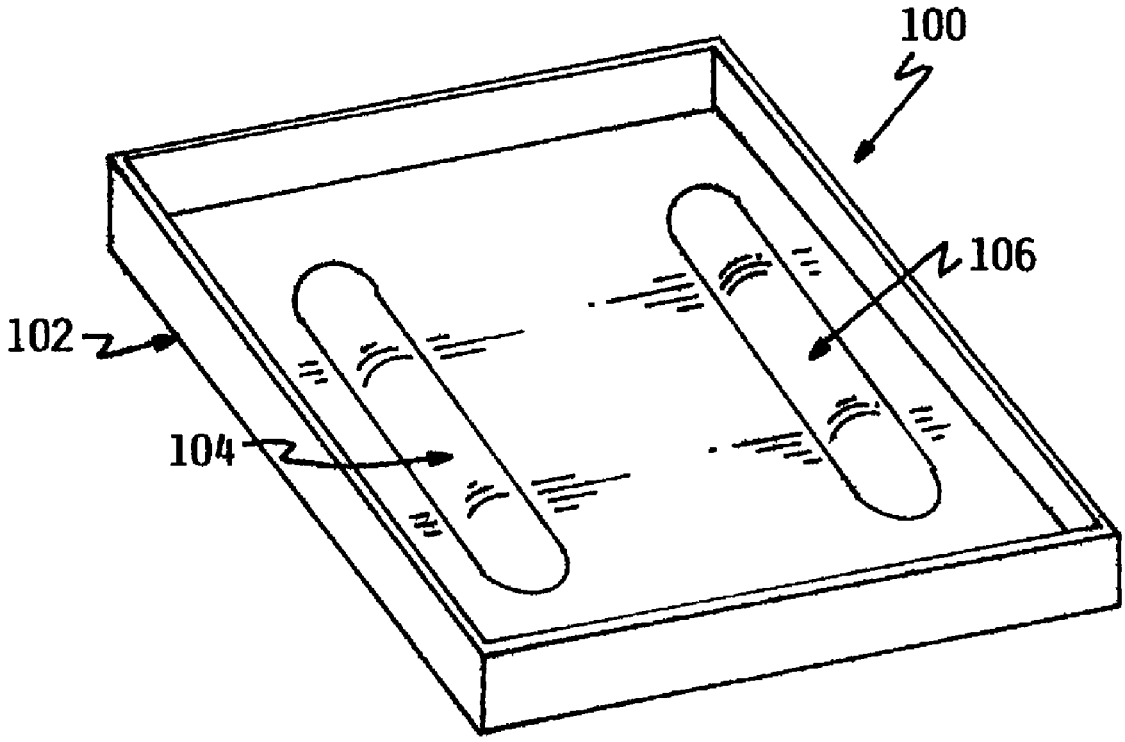
FIG. 3 is a perspective view of another embodiment of a conventional godet that includes an adhesive layer in accordance with the present invention.

As depicted in FIGS. 1-3, godet, or container, 100 is provided having sidewall 102 operably connected to, and extending around the perimeter of, bottom member 104 to define a recess area 105 adapted to receive and store a pressed powder 110 for use as an artist pastel. Godet 100 can include ridges 106 formed along the bottom member 104 to increase the structural integrity of godet 100. In some embodiments, as depicted in FIG. 1, godet 100 can have a substantially circular shape, while in other embodiments, as depicted in FIG. 3, godet 100 can have a rectangular shape. Typically, godets 100 will have a recess area 105 that ranges from about 2 $cm^2$ to about 100 $cm^2$, although one of ordinary skill in the art will recognize that no particular size or shape of godet 100 is required by the present disclosure.

In general, sidewall 102 and bottom portion 104 can be formed from any suitable materials including, for example, polymers, metals, metal alloys, cellulostic materials, fibrous materials such as fiber board, and combinations thereof. Suitable polymers include, for example, polyethylene (PE), high density polyethylene (HDPE), polypropylene (PP), polyvinylchloride (PVC), polycarbonates, polyurethanes, poly(tetrafluoroethylene) (PTFE), acrylonitrile-butadiene-styrene (ABS), styrene-acrylonitrile (SAN), nylon, and polyformaldehyde (Acetal) and combinations thereof. Suitable metals include, for example, tin, aluminum, titanium and alloys and combinations thereof.

As will be described, the containers 100 of the present invention preferably include one or more structural components that serve to increase the adhesion between the container and the pressed powder pastel 110.

In one embodiment, as depicted in FIGS. 1-3, godet 100 includes an adhesive layer 108 that can increase the adhesion of pressed powder 110 to godet 100. In some embodiments, adhesive layer 108 can be applied to the inside surface of bottom member 104, sidewall 102, or a combination thereof. Although adhesive layer 108 is shown extending over generally all of the inner surfaces of bottom member 104 and sidewall 102, it will be understood that not all of those inner surfaces need to be coated with adhesive layer 108 to be within the intended scope of the present invention. In general, adhesive layer 108 can comprise any adhesive suitable for bonding a pressed powder to desired surfaces of godet 100 including, for example, solvent-based adhesives, water-based adhesives or a combination thereof. In one embodiment, the adhesive material is 2 Way Glue™ available from ZIG, manufactured by Kuretake Co., Ltd. Japan. Other suitable adhesives include, for example, epoxies, cyanoacrylates, urethane-based adhesives, urea-based adhesives, polymers containing tackifying agents, polyvinylacetate (PVA) adhesives, polyacrylate adhesives, and combinations thereof. Preferably, adhesive layer 108 is not formed of a thermally activated adhesive as the heating required to activate such an adhesive has the potential to damage and/or alter the chemical composition of pastel pressed powder 110.

Adhesive layer 108 can be formed by coating a suitable adhesive material directly onto desired surfaces of godet 100. For example, an adhesive can be dissolved or dispersed in a suitable solvent to form a solvent/adhesive mixture, which can be coated onto desired surfaces of godet 100. The solvent can then be evaporated to produce an adhesive layer. Suitable coating methods include, for example, spray coating, dip coating, brush coating and combinations thereof. Additionally or alternatively, adhesive layer 100 can be formed by a positioning a double-sided adhesive membrane or tape onto desired surfaces of godet 100.

Figure 4:
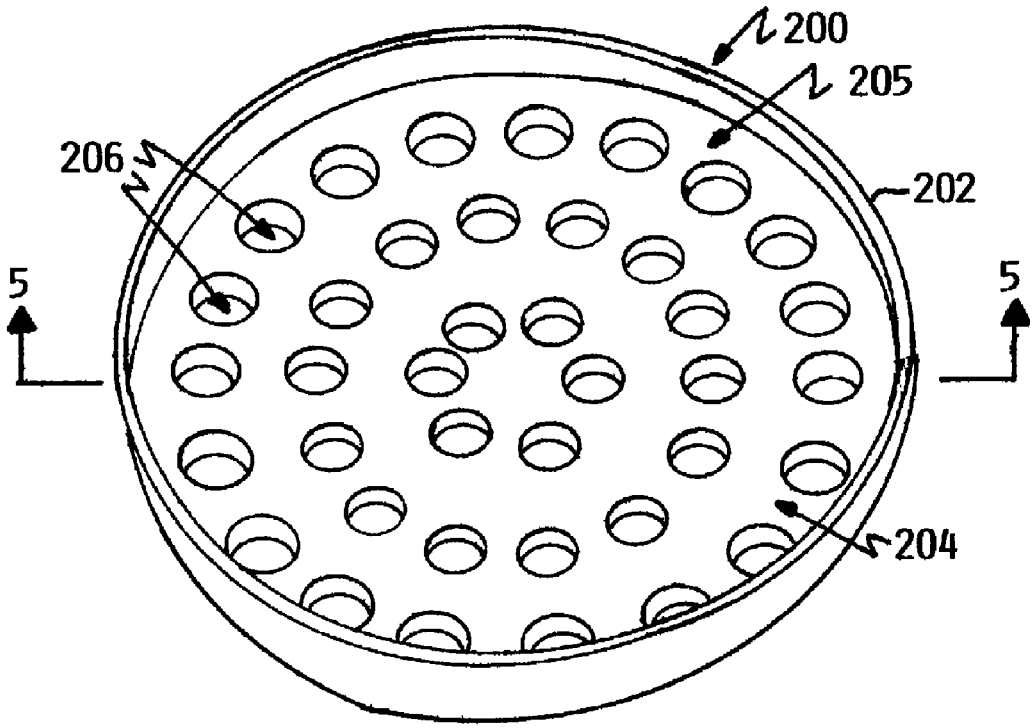
FIG. 4 is a perspective view of a godet having surface features in the form of cavities formed into the bottom surface of the godet.
Figure 5:
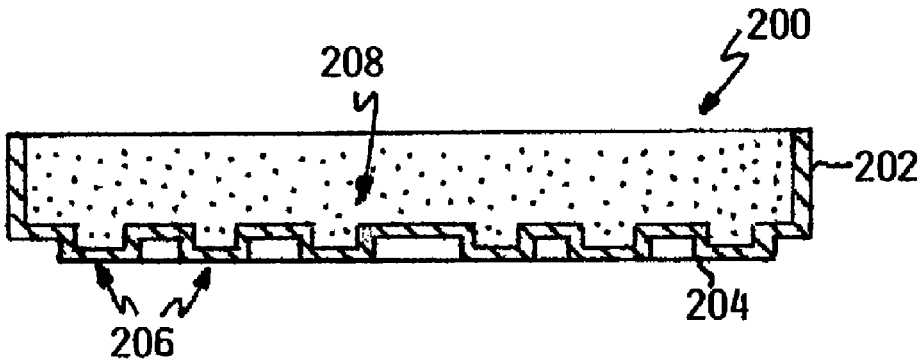
FIG. 5 is a cross-sectional view of the godet of FIG. 4, depicting a pressed powder formulation filling in the cavities in the bottom creating an effective mechanical interlock between the powder and the godet.

Referring to FIGS. 4 and 5, a godet 200 is depicted having sidewall 202 operably coupled to, and extending around the periphery of, bottom member 204 to define a recess area 205 adapted to receive and store a pressed powder. In this embodiment, bottom member 204 includes surface features that can facilitate mechanical interlocking between a pressed powder and the godet. As depicted in FIGS. 4 and 5, the surface features can be a plurality of cavities 206, which can facilitate a mechanical interlock with pressed powder 208. In other words, as depicted in FIG. 5, pressed powder 208 can generally interdigitate into cavities, or indentations, 206, which can help anchor pressed powder 208 in godet 200 such that pressed powder 208 better resists cracking and/or breaking during application of powder 208 to a desired substrate.

Figure 8:
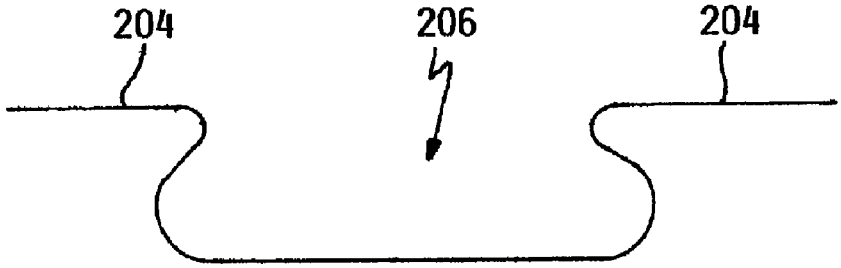
FIG. 8 is a cross-sectional view of one cavity having a generally mushroom shape including an undercut portion.

Cavities 206 can have any appropriate cross-sectional shape such as, for example, circular, substantially circular, elliptical, rectangular, and the like and combinations thereof. As depicted in FIG. 8, in one embodiment, cavities 206 can form a generally inverted mushroom-like shape with an undercut portion and curved edges proximate the top of each cavity so as to maximize the lateral force component on the pastel pressed powder 210, while minimizing any sharp edges that may tend to form cutting edges for the pressed powder 210 and/or catch applicators once the level of powder has been consumed to the point where portions of the bottom surface of container 100 start to be exposed.

In some embodiments, cavities 206 can be randomly spaced along the surface of bottom member 204, while in other embodiments cavities 206 can be arranged in regular patterns along the surface of bottom member 204. Preferably, cavities 206 can have an effective diameter from about 0.5 mm to about 10.0 mm and a depth from about 0.3 mm to about 5.0 mm. Preferably, the surface area exposed by cavities 206 occupies from about 5 to about 65 percent of the recess area 205 of bottom member 204 defined by the perimeter of bottom member 204, and preferably from about 20 to about 40 percent of the recess area 205.

In other embodiments, the surface features can be achieved by a roughened surface formed into bottom member 204. In these embodiments, the roughed surface can be formed by chemical etching, sand blasting, mechanical abrasion blasted, peened, roll-textured, molded, electrically etched or similar techniques to simulate a texture of non-toothed sandpaper (i.e., not sharp but surface area coverage and grit size), as well as combinations thereof. In general, the roughed surface can contain microscopic holes or pores, which permit a pressed powder to mechanically interlock with the container, which can prevent cracking and breaking of the powder during application of the powder. In one embodiment, the surface features can be defined in terms of an equivalent surface area that is preferably at least twice, and more preferably at least three times, that of the surface area defined by the perimeters of the container. In another embodiment, the surface features create an equivalent roughness of the surface that is equivalent to a roughness measure ranging from 150 to 600 grit, and more preferably between 150 to 400 grit.

Figure 6:
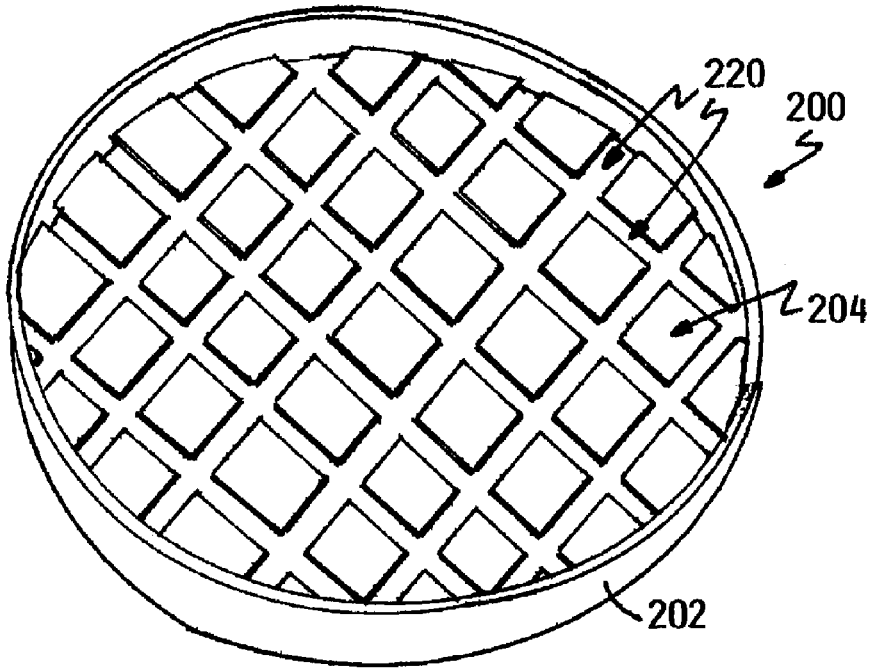
FIG. 6 is a perspective view of a godet having a plurality of channels formed into the bottom surface of the godet to facilitate mechanical interlocking of a pressed powder and the godet.

Referring to FIG. 6, in another embodiment, bottom portion 204 of godet 200 can include a plurality of channels 220, which can facilitate mechanical interlocking between godet 200 and pastel pressed powder 210. As depicted in FIG. 6, in some embodiments, channels 220 can be formed in a criss-crossing arrangement along the surface of bottom portion 204. However, in other embodiments, channels 220 can be formed in a generally parallel relationship relative to each other along the surface of bottom portion 204. Godet 200 may further include an adhesive layer, as described above, coating the inside surface of sidewall 202 and/or bottom member 204. In one embodiment, channels 220 generally have a width of between 0.5 mm and 10.0 mm and a depth of between 0.3 mm to 5.0 mm and are preferably regularly spaced at intervals of between 0.5 mm to 10.0 mm.

Figure 7:
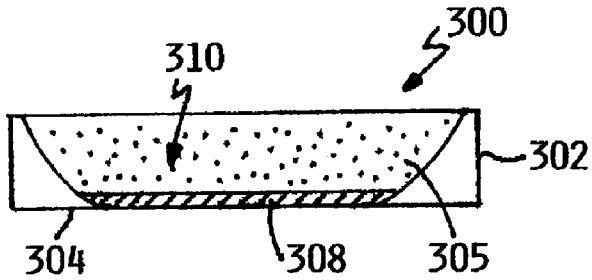
FIG. 7 is a cross-sectional view of godet having sloping side portions, which can reduce the build up of pressed powder in the corner or outer edge portion of the godet.

Referring to FIG. 7, godet 300 is depicted comprising sidewall 302 operably coupled to bottom member 304 to define a recess area 305 adapted to hold and store pastel pressed powder 310. In these embodiments, sidewall 302 can be sloped, which prevents pressed powder 310 from accumulating in the corner and/or edge portions of godet 300. In some embodiments, an adhesive layer 308 can be positioned along an inside surface of bottom member 304 to increased the adhesion between godet 300 and pressed powder 310. Additionally, the inside surface of bottom member 304 may comprise protrusions, cavities and/or channels (not shown) to facilitate mechanical interlocking between godet 300 and pressed powder 310.

Figure 9:
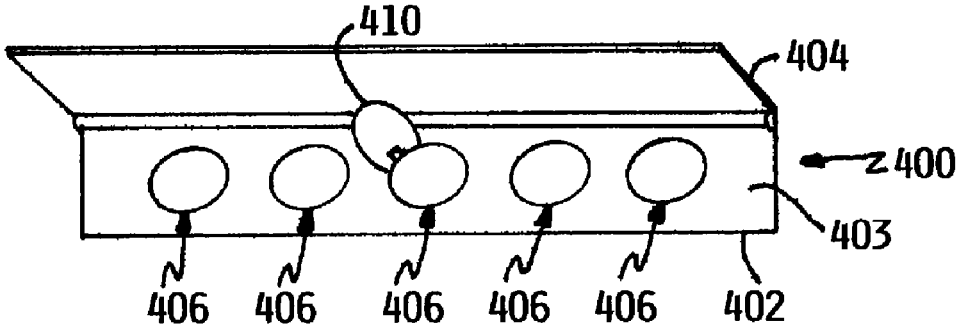
FIG. 9 is an isometric view of a case having a plurality of godets housed within the case, with one godet having a lid member in an open configuration.
Figure 10:
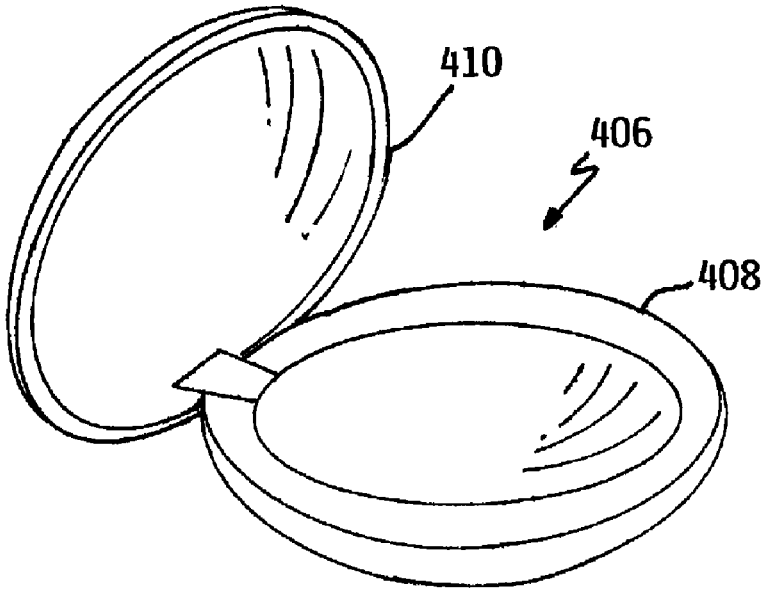
FIG. 10 is a perspective view of a godet having a lid member operably coupled to the godet, the lid member depicted in an open configuration.

Referring to FIGS. 9 and 10, a case 400 is depicted having body portion 402 operably coupled to lid portion 404. Generally, body portion 402 comprises one or more sidewalls operably coupled to a bottom member to define an interior portion 403. In one embodiment, the interior portion 403 can be adapted to receive a plurality of godets 406. In some embodiments, each of the plurality of godets can house a different colored artist pastel. Lid member 404 can be selectively moved from an open configuration, depicted in FIG. 8, to a closed configuration.

In some embodiments, as depicted in FIG. 9, each of the plurality of godets 406 can include a body portion 408 operably coupled to an individual lid member 410. Lid member 410 can be selectively moved between an open position, depicted in FIG. 10, and a closed positioned, which facilitates isolating a pressed powder located within body portion 408, which can reduce contamination of the pressed powder stored with godets 406. Additionally, in some embodiments, lid member 410 can be composed of a transparent material, which permits a user to identify the appearance of the pressed powder stored with a particular godet 406 without opening lid member 410.

Figure 11:
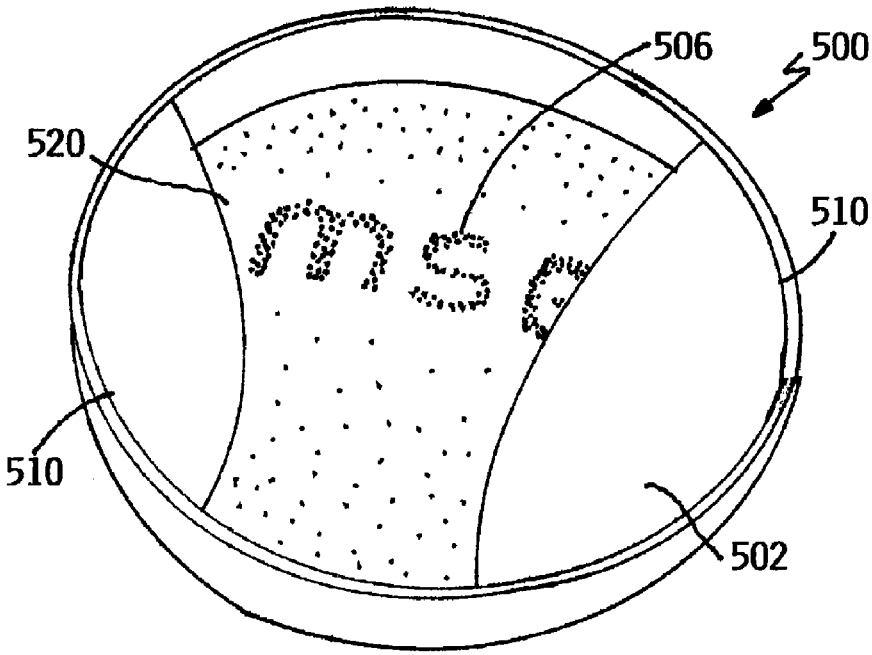
FIGS. 11 and 12 are perspective view of an alternate embodiment in which a graphic or message is formed by the surface features and/or adhesive layer in accordance with the present invention.
Figure 12:
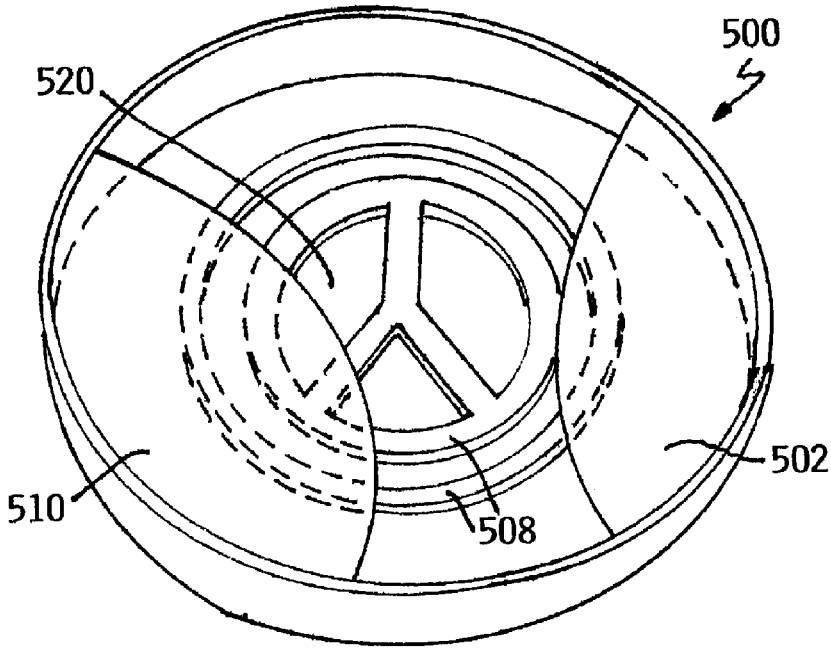

In another embodiment as shown in FIGS. 11 and 12, a pattern or message 520 can be defined in bottom portion 502 of container 500 by the arrangement of either the surface features 506, adhesive layer 508, or combination thereof. In this embodiment, as the pressed powder 510 is used from the container 500, areas of the bottom portion 502 have the pressed powder 510 removed, but the pressed powder 510 remains in those areas of the bottom portion 502 as retained by either surface features 506, as shown in FIG. 11, or adhesive layer 508, as shown in FIG. 12. Preferably, the pattern or message 520 can be used to display an alphanumeric message, initials, trademarks, or even graphics or design patterns.

As described above, the godets of the present disclosure are specifically adapted to store a pressed powder for use as an artist pastel. Preferably, the colorized pastel pressed powder composition has a durometer of less than about 70 Shore A and a pigment content of at least 25%, and more preferably at least 40%. More preferably, the colorized pastel pressed powder composition has a durometer of between about 5 and 50 Shore A, and more preferably between about 30 and 45 Shore A. Suitable pastel composition are described in, for example, co-pending patent application Ser. No. 11/042,708, filed on Jan. 25, 2005, entitled "Novel Oil Pastel Compositions And Methods Of Making Same," and co-pending patent application Ser. No. 11/042,712, filed on Jan. 25, 2005, entitled "Novel Soft Pastel Compositions And Methods Of Making Same," both of which are hereby incorporated by reference herein.

The above embodiments are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. A godet for storing and utilizing artist pastels comprising:

a container having a bottom, at least one side and a top opening that defines a recess area;

surface features formed at least along and integral with an inner surface extending over substantially all of the bottom of the container;

a non-thermally activated adhesive layer positioned generally along at least a portion of the inner surface of the bottom of the container; and a colorized pressed powder material positioned within the recess area on top of the adhesive layer, the colorized pressed powder material being adapted to be used as an artist pastel and having a pigment content of at least 25 percent.

2. The godet of claim 1 wherein the surface features are adapted to create a generally lateral force component applied to the pressed powder material that resists cracking of the pressed powder material in response to removal of a portion of the pressed powder material from the top opening.

3. The godet of claim 1 wherein the surface features include a plurality of indentations defined in at least the inner surface of the bottom of the container.

4. The godet of claim 3 wherein the plurality of indentations occupy from about 5 to about 65 percent of the surface area of the bottom.

5. The godet of claim 3 wherein the plurality of indentations occupy from about 20 to about 40 percent of the surface area of the bottom.

6. The godet of claim 3 wherein each of the plurality of indentations have a lateral cross section that includes an undercut region and a rounded upper edge.

7. The godet of claim 3 wherein the plurality of indentations have an effective diameter from about 0.5 to about 10.0 mm.

8. The godet of claim 3 wherein the plurality of indentations have an effective depth from about 0.3 to about 5.0 mm.

9. The godet of claim 1 wherein the surface features have an effective roughness of between about 100 and 600 grit.

10. The godet of claim 9 wherein the surface features have an effective roughness of between about 150 and 400 grit.

11. The godet of claim 1 wherein the surface features have an effective surface area that is at least twice a surface area defined by a perimeter of the recess area.

12. The godet of claim 11 wherein the surface features have an effective surface area that is at least three times a surface area defined by a perimeter of the recess area.

13. The godet of claim 1 wherein the at least one side includes an inner surface and an outer surface and wherein the outer surface is generally perpendicular to the bottom and the inner surface is curved relative to the bottom and merges into the bottom at a bottom of the inner surface and into the top of the outer surface of the side at a top of the inner surface.

14. The godet of claim 1 wherein the adhesive layer is formed by a material selected from the set consisting of: a sprayed-on non-thermally activated adhesive material, a painted-on non-thermally activated adhesive material or a double sided adhesive film material.

15. The godet of claim 1 wherein the colorized pressed powder material has a durometer of less than about 70 Shore A.

16. A godet for storing and utilizing artist pastels comprising:

a container having a bottom, at least one side and a top opening that defines a recess area;

surface features formed at least along and integral with an inner surface extending over substantially all of the bottom of the container that create a generally lateral force component applied to the pressed powder material that resists cracking of the pressed powder material in response to removal of a portion of the pressed powder material from the top opening; and a colorized pressed powder material positioned within the recess area on top of the surface features, the colorized pressed powder material being adapted to be used as an artist pastel and having a pigment content of at least 25 percent.

17. The godet of claim 16 wherein the surface features include a plurality of indentations defined in at least the inner surface of the bottom of the container.

18. The godet of claim 17 wherein the plurality of indentations occupy from about 5 to about 65 percent of the surface area of the bottom of the container.

19. The godet of claim 17 wherein each of the plurality of indentations have a lateral cross section that includes an undercut region and a rounded upper edge.

20. The godet of claim 17 wherein the plurality of indentations have an effective diameter from about 0.5 to about 10.0 mm.

21. The godet of claim 17 wherein the plurality of indentations have an effective depth from about 0.3 to about 5.0 mm.

22. The godet of claim 16 wherein the surface features have an effective roughness of between about 100 and 600 grit.

23. The godet of claim 22 wherein the surface features have an effective roughness of between about 150 and 400 grit.

24. The godet of claim 16 wherein the surface features have an effective surface area that is at least twice a surface area defined by a perimeter of the recess area.

25. The godet of claim 24 wherein the surface features have an effective surface area that is at least three times a surface area defined by a perimeter of the recess area.

26. The godet of claim 24 wherein the surface features are arranged in a pattern that is revealed when the pressed powder material is used down to a level generally at the bottom of the container.

27. The godet of claim 16 wherein the at least one side includes an inner surface and an outer surface and wherein the outer surface is generally perpendicular to the bottom and the inner surface is curved relative to the bottom and merges into the bottom at a bottom of the inner surface and into the top of the outer surface of the side at a top of the inner surface.

28. The godet of claim 16 further comprising:

a non-thermally activated adhesive layer positioned generally along at least a portion of an inner surface of the bottom of the container.

29. The godet of claim 28 wherein the adhesive layer is formed by a material selected from the set consisting of: a sprayed-on non-thermally activated adhesive material, a painted-on non-thermally activated adhesive material or a double sided adhesive film material.

30. The godet of claim 16 wherein the colorized pressed powder material has a durometer of less than about 70 Shore A.

31. A method of storing and utilizing an artist pastel comprising:

providing a godet having a body comprising at least one sidewall operably coupled to a bottom member to define a recess area;

providing surface features formed at least along and integral with an inner surface extending over substantially all of the bottom of the container;

providing a powder that is colorized for use as the artist pastel;

pressing the powder into the recess area of the godet such that the pressed powder has a durometer of less than about 70 Shore A, has a pigment content of at least 25 percent and is adapted for use as the artist pastel; and removing the artist pastel pressed powder from the godet and applying the artist pastel pressed powder to a surface other than human tissue.

* * * * *

UNITED STATES PATENT AND TRADEMARK OFFICE

CERTIFICATE OF CORRECTION

PATENT NO. : 7,422,101 B1
APPLICATION NO. : 11/212196
DATED : September 9, 2008
INVENTOR(S) : Forsline et al.

It is certified that error appears in the above-identified patent and that said Letters Patent is hereby corrected as shown below:

Title page, Item (73):

After "Assignee:" delete "Colorfin, LLC" and insert -- Ladd Forsline --.

Signed and Sealed this
Eleventh Day of September, 2012

David J. Kappos

David J. Kappos
*Director of the United States Patent and Trademark Office*